US010682003B2

(12) United States Patent
Schooley

(10) Patent No.: US 10,682,003 B2
(45) **Date of Patent: *Jun. 16, 2020**

(54) COLLAPSIBLE ARTIFICIAL TREE

(71) Applicant: BALSAM HILL LLC, Redwood City, CA (US)

(72) Inventor: Bruce A. Schooley, Alamo, CA (US)

(73) Assignee: BALSAM INTERNATIONAL UNLIMITED COMPANY, Dublin (IE)

( * ) Notice: Subject to any disclaimer, the term of this patent is extended or adjusted under 35 U.S.C. 154(b) by 713 days.

This patent is subject to a terminal disclaimer.

(21) Appl. No.: 14/720,037

(22) Filed: May 22, 2015

(65) Prior Publication Data

US 2015/0250344 A1 Sep. 10, 2015
US 2020/0146490 A9 May 14, 2020

Related U.S. Application Data

(63) Continuation of application No. 13/545,283, filed on Jul. 10, 2012, now Pat. No. 9,040,130, which is a (Continued)

(51) Int. Cl.
*A47G 33/06* (2006.01)
*A47G 33/12* (2006.01)

(52) U.S. Cl.
CPC ..... *A47G 33/06* (2013.01); *A47G 33/12* (2013.01); *A47G 2033/1273* (2013.01); *Y10T 29/49716* (2015.01)

(58) Field of Classification Search
CPC ..... A47G 33/06; A41G 1/007
See application file for complete search history.

(56) References Cited

U.S. PATENT DOCUMENTS 891,301 A * 6/1908 Spreen ..... A47G 33/06 428/20
1,397,931 A 11/1921 Kurtz
(Continued)

FOREIGN PATENT DOCUMENTS

CN 2528331 Y 1/2003
CN 2845631 Y 12/2006
(Continued)

OTHER PUBLICATIONS

English language translation of description and claims from DE 299 02 141 U1, Feb. 6, 2018 (Year: 2018).*
(Continued)

*Primary Examiner* — Adam Krupicka
(74) *Attorney, Agent, or Firm* — Tarolli, Sundheim, Covell & Tummino LLP

(57) ABSTRACT

The artificial tree is collapsible by inverting a main trunk thereof to swap positions of a first end and second end. The limbs are pivotably attached to the main trunk so that they sag under force of gravity from a deployed more horizontally extending orientation to a collapsed more vertically extending orientation when the main trunk is inverted. A base is preferably provided which has wheels and static portions in contact with the ground for supporting the tree thereon. A riser extending up from the base is configured to have an end of the main trunk rest therein. A lock is also preferably provided to hold an end of the trunk within the riser of the base. A separate treetop portion is removably attachable to ends of the trunk to complete the tree when in a deployed configuration and for storage of the treetop when the tree is not collapsed.

25 Claims, 6 Drawing Sheets

Related U.S. Application Data continuation-in-part of application No. 13/302,873, filed on Nov. 22, 2011, now Pat. No. 8,993,077, which is a continuation of application No. 12/798,496, filed on Apr. 5, 2010, now Pat. No. 8,062,718, which is a continuation-in-part of application No. PCT/US2008/013587, filed on Dec. 10, 2008.

(60) Provisional application No. 61/629,957, filed on Nov. 30, 2011.

(56) References Cited

U.S. PATENT DOCUMENTS

| | | | | |
|---|---|---|---|---|
| 1,495,695 | A | 5/1924 | Karr | |
| 1,576,639 | A | 3/1926 | English | |
| 1,577,873 | A | 6/1926 | Root | |
| 1,599,083 | A | 9/1926 | Gagne | |
| 1,694,974 | A | 12/1928 | Glover | |
| 1,764,540 | A | 6/1930 | Vydra | |
| 2,186,351 | A * | 1/1940 | Stojaneck | A47G 33/06 362/123 |
| 2,519,690 | A | 8/1950 | Recktenwald | |
| 2,708,324 | A | 5/1955 | Wedden | |
| 2,788,598 | A * | 4/1957 | Surber | A47G 33/06 248/188.5 |
| 2,826,845 | A | 3/1958 | Warren | |
| 2,826,846 | A | 3/1958 | Warren | |
| 2,863,466 | A | 12/1958 | Small | |
| 2,988,837 | A | 6/1961 | Hutton | |
| 3,126,310 | A * | 3/1964 | Suber | A47G 33/06 428/7 |
| 3,574,102 | A | 4/1971 | Hermanson | |
| 3,632,076 | A | 1/1972 | Rogers, Jr. | |
| 3,643,292 | A | 2/1972 | Mayer | |
| 3,643,935 | A | 2/1972 | Bell | |
| 3,744,503 | A | 7/1973 | Wolff et al. | |
| 3,765,434 | A | 10/1973 | Riggs | |
| 3,801,415 | A | 4/1974 | Fristot | |
| 3,819,457 | A | 6/1974 | Mottel | |
| 3,846,213 | A | 11/1974 | Thiemann | |
| 3,849,834 | A | 11/1974 | Mayer | |
| 3,879,146 | A | 4/1975 | Mayer | |
| 3,900,637 | A | 8/1975 | Byrd et al. | |
| 3,928,689 | A | 12/1975 | Mottel | |
| 3,959,536 | A | 5/1976 | Chase | |
| 3,970,834 | A | 7/1976 | Smith | |
| 4,054,696 | A | 10/1977 | Crownover | |
| 4,072,857 | A | 2/1978 | Devicaris | |
| 4,093,758 | A | 6/1978 | Weskamp et al. | |
| 4,095,778 | A | 6/1978 | Wing | |
| 4,109,345 | A | 8/1978 | Sargent et al. | |
| 4,140,823 | A * | 2/1979 | Weskamp | A47G 33/06 428/20 |
| 4,144,364 | A | 3/1979 | Tice | |
| 4,451,510 | A | 5/1984 | Boisvert et al. | |
| 4,468,421 | A | 8/1984 | Wang | |
| 4,496,615 | A | 1/1985 | Huang | |
| 4,606,366 | A | 8/1986 | Collet | |
| 4,659,597 | A | 4/1987 | Lau | |
| 4,847,123 | A | 7/1989 | Armstead et al. | |
| 4,980,608 | A | 12/1990 | Morrison | |
| 5,342,661 | A | 8/1994 | Wilcox, II | |
| 5,490,599 | A | 2/1996 | Tohidi | |
| 5,652,032 | A | 7/1997 | Kaczor et al. | |
| 5,820,248 | A | 10/1998 | Ferguson | |
| 5,855,705 | A | 1/1999 | Gauthier | |
| 5,869,151 | A | 2/1999 | Chong | |
| 5,915,742 | A | 6/1999 | Hung | |
| 5,957,145 | A * | 9/1999 | Plumer | E04H 12/2238 135/117 |
| 6,099,920 | A | 8/2000 | Kao | |
| 6,152,156 | A | 11/2000 | Tung | |
| 6,257,793 | B1 | 7/2001 | Lin | |
| 6,333,083 | B1 | 12/2001 | Smedley et al. | |
| 6,394,634 | B2 | 5/2002 | Kitchin | |
| 6,458,435 | B1 | 10/2002 | Lai | |
| 6,514,581 | B1 | 2/2003 | Gregory | |
| 6,588,914 | B1 | 7/2003 | Tang | |
| 6,689,147 | B1 | 2/2004 | Koster, Jr. | |
| 7,055,981 | B2 | 6/2006 | Yao | |
| 7,122,230 | B1 | 10/2006 | Maskell | |
| 7,128,954 | B2 | 10/2006 | Tsai | |
| 7,160,588 | B2 | 1/2007 | Sanford et al. | |
| 7,232,596 | B2 | 6/2007 | Lai | |
| 7,267,852 | B1 | 9/2007 | Rosado et al. | |
| 7,445,823 | B2 | 11/2008 | Tennison | |
| 7,445,824 | B2 | 11/2008 | Leung et al. | |
| 7,493,909 | B2 | 2/2009 | Ma | |
| 7,585,552 | B2 | 9/2009 | Meseke | |
| 7,717,375 | B2 | 5/2010 | Chen | |
| 8,062,718 | B2 | 11/2011 | Schooley | |
| 8,993,077 | B2 | 3/2015 | Schooley | |
| 9,040,130 | B2 | 5/2015 | Schooley | |
| 9,581,287 | B2 | 2/2017 | Jalbert et al. | |
| 2004/0111935 | A1 | 6/2004 | Tipay | |
| 2004/0191431 | A1 | 9/2004 | Lai | |
| 2005/0249892 | A1 | 11/2005 | Rocheleau | |
| 2007/0177395 | A1 | 8/2007 | Bryant | |
| 2008/0038490 | A1 | 2/2008 | Tennison | |
| 2008/0283717 | A1 | 11/2008 | Kim et al. | |
| 2009/0061120 | A1 | 3/2009 | Leung et al. | |
| 2009/0071285 | A1 | 3/2009 | Lauderbaugh | |
| 2013/0175840 | A1 | 7/2013 | Nadav | |
| 2015/0211674 | A1 | 7/2015 | Jalbert et al. | |

FOREIGN PATENT DOCUMENTS

| | | | |
|---|---|---|---|
| CN | 201504969 | U | 6/2010 |
| CN | 2356598 | Y | 2/2012 |
| DE | 29902141 | U1 | 5/1999 |
| EP | 0368539 | B2 | 8/1998 |
| GB | 190527033 | A | 3/1906 |
| GB | 843220 | A | 8/1960 |
| GB | 846321 | A | 8/1960 |
| GB | 874704 | A | 8/1961 |
| JP | 55-12871 | U | 1/1980 |
| JP | 55012871 | U | 1/1980 |
| JP | 59075017 | A | 4/1984 |
| JP | 4316603 | A | 11/1992 |
| WO | 1997-037572 | A1 | 10/1997 |
| WO | 2008/094168 | A2 | 8/2008 |

OTHER PUBLICATIONS

Supplementary European Search Report dated Aug. 18, 2015.

U.S. Patent and Trademark Office, Office Action & 892 dated Jul. 22, 2014, in related U.S. Appl. No. 13/545,283.

Reply in Support of Motion for Attorneys' Fees—Case No. 16-CV-07255-WHO, in the U.S. District Court for the Northern District of California, San Francisco Division, Dec. 21, 2017.

Order Denying Balsam's Temporary Restraining Order—Case No. 15-cv-04829-WHO, in the U.S. District Court for the Northern District of California, San Francisco Division, Nov. 12, 2015.

Joint Claim Construction and Prehearing Statement Under Patent L.R. 4-3—Case No. 15-CV-04829-WHO, in the U.S. District Court for the Northern District of California, San Francisco Division, May 23, 2016.

Answer to Plantiffs' Second Amended Complaint and Related Counter-Claims—Case No. 15-cv-04829-WHO, in the U.S. District Court for the Northern District of California, San Francisco Division, Oct. 31, 2016.

UCP's Reply to Its Motion for Summary Judgment of Non-Infringement—Case No. 16-CV-07255-WHO, in the U.S. District Court for the Northern District of California, San Francisco Division, Jul. 28, 2017.

Order Granting Motion for Summary Judgment—Case No. 16-cv-07255-WHO, in the U.S. District Court for the Northern District of California, San Francisco Division, Nov. 3, 2017.

UCP's Notice of Motion and Motion for Attorneys' Fees—Case No. 16-CV-07255-WHO, in the U.S. District Court for the Northern District of California, San Francisco Division, Nov. 30, 2017.

(56) References Cited

OTHER PUBLICATIONS

Balsam's Opposition to UCP's Motion for Attorneys' Fees—Case No. 16-cv-07255-WHO, in the U.S. District Court for the Northern District of California, San Francisco Division, Dec. 13, 2017.
Declaration of Will B. Fitton in Support of Balsam's Opposition to UCP's motion for Attorneys' Fees—Case No. 16-cv-07255-WHO, in the U.S. District Court for the Northern District of California, San Francisco Division, Dec. 13, 2017.
Defendants Balsam Brands Inc. and Balsam International Unlimited Company's Opposition to Plantiffs' Motion for Summary Judgment—Case No. 16-cv-07255-WHA, in the U.S. District Court for the Northern District of California, San Francisco Division, Jul. 17, 2017.
Defendant Cinmar, LLC d/b/a Frontgate, Grandin Road and Frontgate Marketing, Inc.'s Responsive Claim Construction Brief—Civil Action No. 15-cv-04829-WHO, in the U.S. District Court for the Northern District of California, San Francisco Division, Aug. 17, 2016.
UCP's Notice of Motion and Motion for Summary Judgment of Non-Infringement—Case No. 16-CV-07255-WHO, in the U.S. District Court for the Northern District of California, San Francisco Division, Jun. 26, 2017.
Supplemental Declaration of Patricia L. Peden—Case No. 16-CV-07255-WHO, in the U.S. District Court for the Northern District of California, San Francisco Division, Dec. 20, 2017.
Plaintiffs' Disclosure of Asserted Claims and Infringement Contentions and Accompanying Document Production-Case No. 15-cv-04829-WHO, in the U.S. District Court for the Northern District of California, San Francisco Division, Feb. 2, 2016.
Plaintiffs' Opening Claim Construction Brief for U.S. Pat. No. 8,062,718 and U.S. Pat. No. 8,993,077—Case No. 15-CV-04829-WHO, in the U.S. District Court for the Northern District of California, San Francisco Division, Jul. 22, 2016.
Plaintiffs' Reply in Support of Claim Construction—Case No. 15-CV-04829-WHO, in the U.S. District Court for the Northern District of California, San Francisco Division, Aug. 23, 2016.
Transcript of Proceedings for Claim Construction—Case No. 15-CV-4829 WHO, n the U.S. District Court for the Northern District of California, San Francisco Division, Aug. 29, 2016.
Transcript of Proceedings for Non-Infringement MSJ, including hand-up documents—No. 16-CV-7255 WHO, in the U.S. District Court for the Northern District of California, San Francisco Division, Sep. 20, 2017.
Plaintiffs' Preliminary Claim Constructions and Evidence—Case No. 15-cv-04829-WHO, in the U.S. District Court for the Northern District of California, San Francisco Division, Apr. 29, 2016.
Defendants' Disclosure Pursuant Local Rule 4-2—Case No. 15-cv-04829-WHO, in the U.S. District Court for the Northern District of California, San Francisco Division, Apr. 29, 2016.
Bruce Schooley, "Design Decisions", Spin Tree (Easy Set up Christmas Tree) Guide, Presented to Merchant Aug. 27, 2008.
Plaintiffs' Disclosure of Asserted Claims and Infringement Contentions and Accompanying Document Production-Case No. 15-cv-04829-WHO, in the U.S. District Court for the Northern District of California, San Francisco Division, Oct. 20, 2015.
Defendants' Invalidity Contentions with Exhibits served in Civil Action No. 15-cv-04829-WHO, in the U.S. District Court for the Northern District of California, San Francisco Division, (redacted) Mar. 18, 2016.
Non-confidential Joint Appendix, vol. I of III, pp. APPX1-APPX689, United States Court of Appeals for the Federal Circuit, Appeal from the United States District Court for the Northern District of California, case No. 3:16-cv-07255, Sep. 12, 2018.
Non-confidential Joint Appendix, vol. II of III, pp. APPX707-APPX3502, United States Court of Appeals for the Federal Circuit, Appeal from the United States District Court for the Northern District of California, case No. 3:16-cv-07255, Sep. 12, 2018.
Non-confidential Joint Appendix, vol. III of III, pp. APPX3563-APPX4062, United States Court of Appeals for the Federal Circuit, Appeal from the United States District Court for the Northern District of California, case No. 3:16-cv-07255, Sep. 12, 2018.
Non-Confidential Brief for Plaintiffs-Appellees, Appeal from the United States District Court for the Northern District of California, case No. 3:16-cv-07255WHO, Jul. 16, 2018.
Opening Brief for Defendants-Appellants, Appeal from the United States District Court for the Northern District of California, case No. 3:16-cv-07255, May 7, 2018.
Non-Confidential Reply Brief for Appellants Balsam Brands Inc. & Balsam International Unlimited Company, Appeal from the United States District Court for the Northern District of California, case No. 3:16-cv-07255, Sep. 5, 2018.
Deposition of Roger L. McCarthy, Ph.D., vol. II from the United States District Court for the Northern District of California, case No. CV-04829-WHO, Aug. 11, 2016.
Deposition of Roger L. McCarthy, P.E., vol. I from the United States District Court for the Northern District of California, case No. 3:15-cv-04829-WHO, Jun. 8, 2016.
Deposition of Paul K. Wright, Ph.D., vol. I from the United States District Court for the Northern District of California, case No. 15-cv-04829-WHO, Jun. 10, 2016.
Claim Construction Order, Case No. 15-cv-04829-WHO, in the U.S. District Court for the Northern District of California, San Francisco Division, Sep. 1, 2016.

* cited by examiner

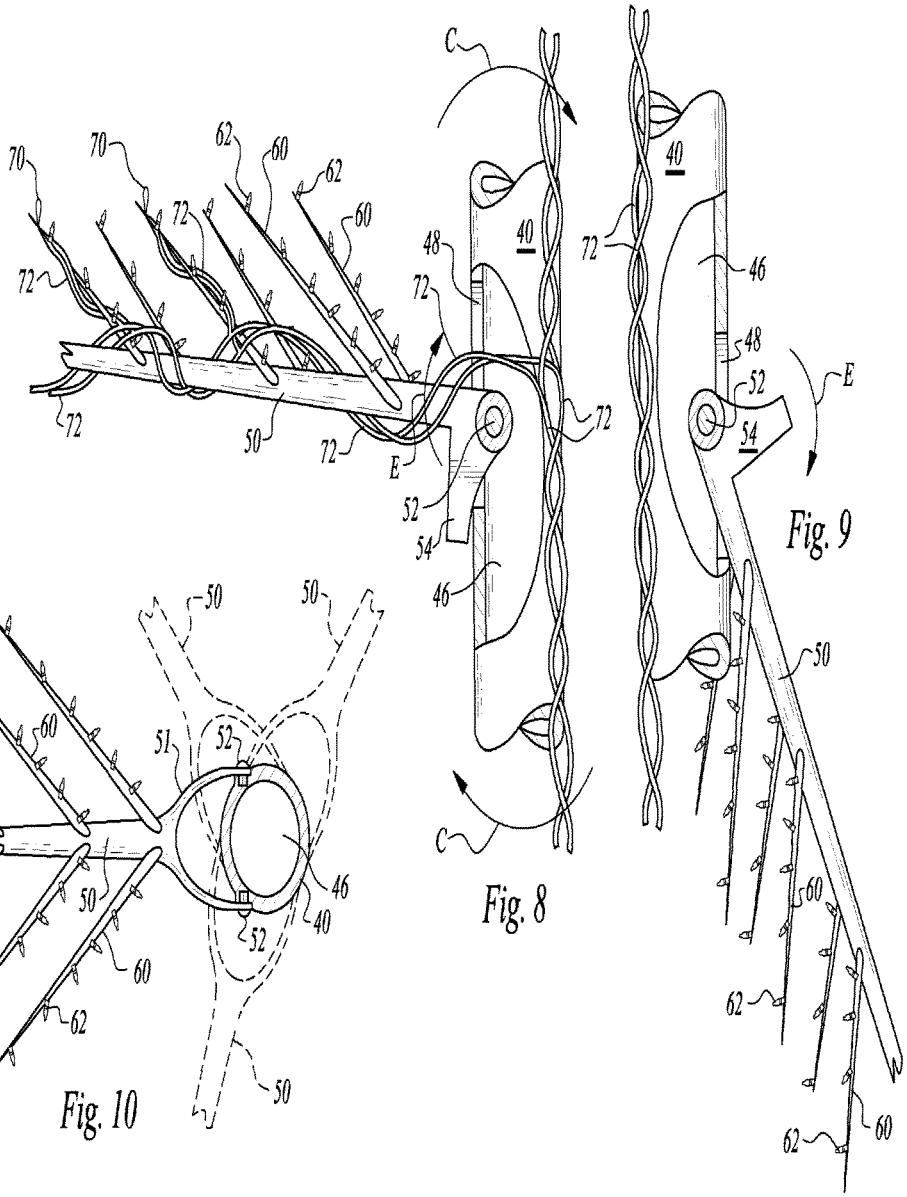
Fig. 8
Fig. 9
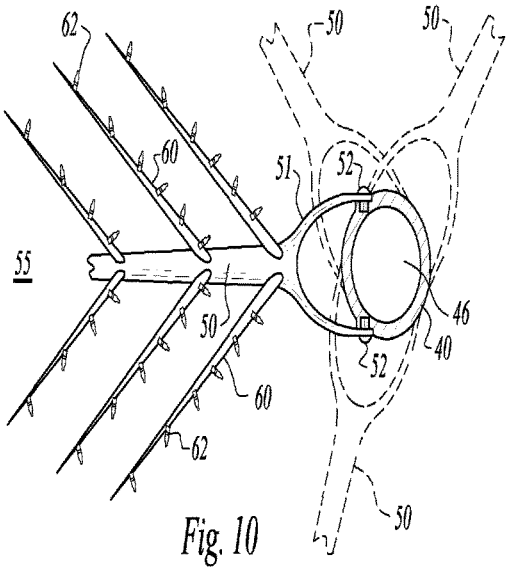
Fig. 10

COLLAPSIBLE ARTIFICIAL TREE

CROSS-REFERENCE TO RELATED APPLICATIONS

This application is a continuation of U.S. application Ser. No. 13/545,283, filed on Jul. 10, 2012, and issued as U.S. Pat. No. 9,040,130 on May 26, 2015, which claims benefit under Title 35, United States Code § 119(e) of U.S. Provisional Application No. 61/629,957 filed on Nov. 30, 2011. The above-identified U.S. application Ser. No. 13/545,283 also is a continuation-in-part of U.S. patent application Ser. No. 13/302,873, filed on Nov. 22, 2011, and issued as U.S. Pat. No. 8,993,077 on Mar. 31, 2015, which is a continuation of U.S. patent application Ser. No. 12/798,496, filed on Apr. 5, 2010 and issued as U.S. Pat. No. 8,062,718 on Nov. 22, 2011, which is a continuation-in-part of and claims priority from International Patent Application No. PCT/US2008/013587 filed on Dec. 10, 2008. This application incorporates by reference the contents of each of the above-identified applications in its entirety.

FIELD OF THE INVENTION

The following invention relates to artificial trees and particularly artificial Christmas trees which can be collapsed and stored when not in use and deployed when intended to be used. More particularly, this invention relates to collapsible artificial trees which collapse by inversion of the tree.

BACKGROUND OF THE INVENTION

When decorating a space, it is often desirable to include trees as part of such decorations. To allow such decorations to last substantially indefinitely without maintenance and allow for repeated cycles of storage and deployment of such decorations, it is desirable to provide artificial trees rather than live trees. An example of such decorations are Christmas trees typically deployed during holiday seasons occurring near the end of each calendar year.

Such artificial trees are often configured to be collapsible so that they take up a minimum of space during initial shipping and inventory before being sold, and also to allow the user to store the tree when not in use in a relatively small space and protected from damage. Some such collapsible Christmas trees or other trees have limbs which are removably attached from a central trunk. The limbs typically include further branches which extend from the limbs which can be formed of wire or other materials with the limbs formed of wood, steel or other relatively rigid materials and the central trunk formed of wood, metal or other materials that are substantially rigid and strong enough to handle the loads encountered by carrying the limbs. Typically, needles of an artificial nature are fastened by wire, adhesive or otherwise to the branches extending from the limbs and/or directly to the limbs themselves.

In some cases lighting is permanently fixed to the limbs, such as with lights coupled to cords and with the cords plugging into a central cord running up the trunk With other collapsible Christmas trees the limbs are not removed from the trunk but rather pivot from a stored orientation to a deployed orientation. With such trees the deployed orientation is generally perpendicular to the trunk and the stored orientation is somewhere between 45° pivoted away from horizontal to a substantially vertical orientation parallel to the trunk.

While such pivotable limbs on Christmas trees have the benefit of avoiding the requirement that the limbs be attached to the central trunk, difficulty is encountered in transitioning the limbs from a collapsed orientation to a deployed orientation. The limb reorienting process is thus highly labor intensive as each limb is adjustably positioned.

SUMMARY OF THE INVENTION

With this invention an artificial tree is provided which is collapsible by inverting a main trunk of the tree from a first deployed orientation to a second collapsed orientation. The tree includes a main trunk which is elongate in form extending from a first end to a second end. Limbs are pivotably attached to the main trunk between the first end and the second end. These limbs are pivotably attached so that the limbs can pivot between a first position when the main trunk is in the deployed orientation to a second position when the main trunk is in the collapsed orientation.

When in the deployed orientation the second end of the main trunk is above the first end. When in a collapsed orientation, the first end of the main trunk is above the second end. In the collapsed orientation the limbs are closer to the second end of the main trunk and less perpendicular to the main trunk. In the deployed orientation, the limbs are oriented closer to horizontal and further from the second end of the main trunk.

Optionally, the limbs can include branches which extend off of the limbs and potentially also needles extending off of the branches (in the case of artificial trees of a type which have needles). Alternatively, leaves can be provided extending from the branches and/or limbs. Lights can also be provided on the limbs and branches. The lights are supplied with electric power by cords which also support the lights thereon and carry electric power from the main trunk.

In a most preferred embodiment a base is also provided along with the main trunk. This base provides a support which can hold the main trunk in the deployed orientation, and preferably but optionally also in the collapsed configuration. The base includes a trunk end supporter, such as in the form of a riser which extends substantially vertically and to which one of the ends of the trunk can be fixed. In the deployed configuration the first end of the trunk is fixed to the riser. In the collapsed orientation the second end of the trunk is fixed to the riser. The riser is preferably carried upon a ground support portion preferably as a portion of various arms joined together and with wheels at the ends of some of the arms. Most preferably, non-moving feet of some kind are also included on the ground support portion of the base so that the base can be kept from rolling when resting upon a horizontal surface or can be tilted somewhat onto wheels of the base and the base can then facilitate easy moving of the trunk and base together utilizing the wheels on the base.

In a most preferred embodiment the riser is fixed to the trunk by configuring the riser to have a hollow core and sizing the first end of the trunk to fit within this hollow core of the riser. Preferably, the second end of the trunk is configured similarly to the first end so that the second end can also fit within the hollow core of the riser. In such a way, the trunk can be supported on the base both when in the deployed configuration and in the collapsed configuration.

Most preferably a lock is provided on the riser which can secure one of the ends of the trunk to the riser. The lock prevents undesired movement of the trunk relative to the riser of the base except when the lock is disengaged. This lock is preferably carried on the riser and interacts with the trunk near one of the ends. As an alternative, the lock could be provided on each of the ends of the trunk and configured to interact with the riser, or otherwise configured partially on both the riser and ends of the trunk to facilitate such locking.

In a most preferred embodiment a treetop is also provided which provides an uppermost portion of an artificial tree. This treetop is configured to have a top trunk of elongate form extending from an upper end to a lower end. Limbs extend from this top trunk which typically match limbs of the main trunk of the artificial tree. The lower end of the treetop is configured to be removably attachable to at least the second end of the main trunk so that the treetop can be carried upon the main trunk to provide an uppermost portion of the artificial tree when in the deployed configuration. Optionally the limbs of the treetop can pivotably attach to the top trunk of the treetop, in a manner such as that provided by the limbs on the main trunk Optionally, the treetop has the upper end also configured to be attachable to the first end of the trunk so that the treetop can be carried upon the main trunk when in the collapsed orientation.

OBJECTS OF THE INVENTION

Accordingly, a primary object of the present invention is to provide an artificial tree which can be easily transitioned from a collapsed orientation to a deployed orientation.

Another object of the present invention is to provide a tree which is easy to store in a collapsed form and easy to deploy when to be used.

Another object of the present invention is to provide a tree which can be readily transitioned between a collapsed and a deployed position with lights associated with the tree remaining coupled to various different portions of the tree both in the collapsed and the deployed configuration.

Another object of the present invention is to provide a Christmas tree which can be set up quickly.

Another object of the present invention is to provide a method for transitioning an artificial tree from a collapsed configuration to a deployed configuration.

Another object of the present invention is to provide an artificial tree which can be inverted between an upside down storage position and a right side up deployed position.

Other further objects of the present invention will become apparent from a careful reading of the included drawing figures, the claims and detailed description of the invention.

BRIEF DESCRIPTION OF THE DRAWINGS

FIG. 8 is a detail of a portion of that which is shown in previous figures, illustrating how a limb can be pivotably attached to the second trunk portion of the invertible tree of this invention.

FIG. 9 is a detail similar to that which is shown in FIG. 8, but after inverting the second trunk portion so that the limb transitions to a stored configuration pivoting away from substantially perpendicular to the second trunk portion.

FIG. 10 is a top plan view of that which is shown in FIG. 8, further illustrating details of a limb according to one form of this invention and illustrating in broken lines how other limbs can be provided in different circumferentially spaced orientations from the second trunk portion of the invertible tree.

DESCRIPTION OF THE PREFERRED EMBODIMENT

Figure 6:
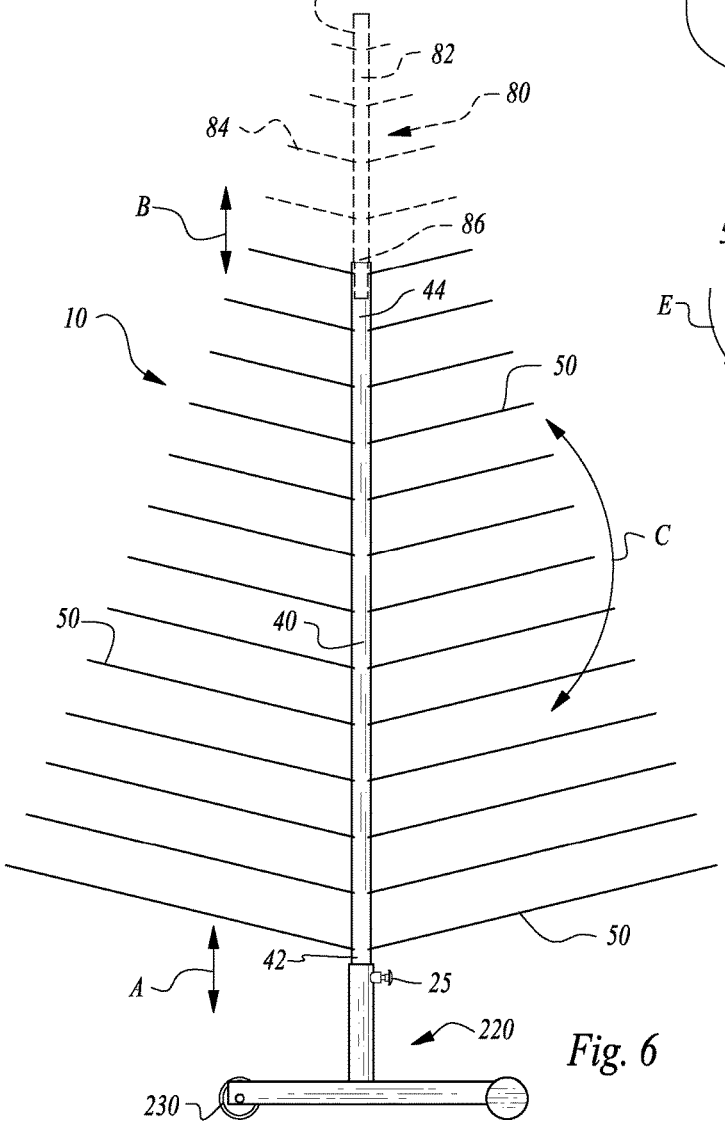
FIG. 6 is a front elevation view of that which is shown in FIG. 5 with the collapsible artificial tree shown in the deployed configuration, and with a treetop portion shown in broken lines.

Referring to the drawings, wherein like reference numerals represent like parts throughout the various drawing figures, reference numeral 10 is directed to a collapsible artificial tree (FIGS. 6 and 7) which collapses by inverting a main trunk 40 of the tree 10 (about arrow C of FIG. 6). In this way, when the tree 10 is to be stored it has a lesser width to be stored in a smaller space. A stand is also optionally provided in the form of a base 20 which preferably includes wheels 30 and a riser 22 or other trunk 40 end support which supports one of the ends 42, 44 of the main trunk 40 for either support of the tree 10 when in a deployed configuration or when in a collapsed configuration (see FIGS. 6 and 7).

Figure 4:
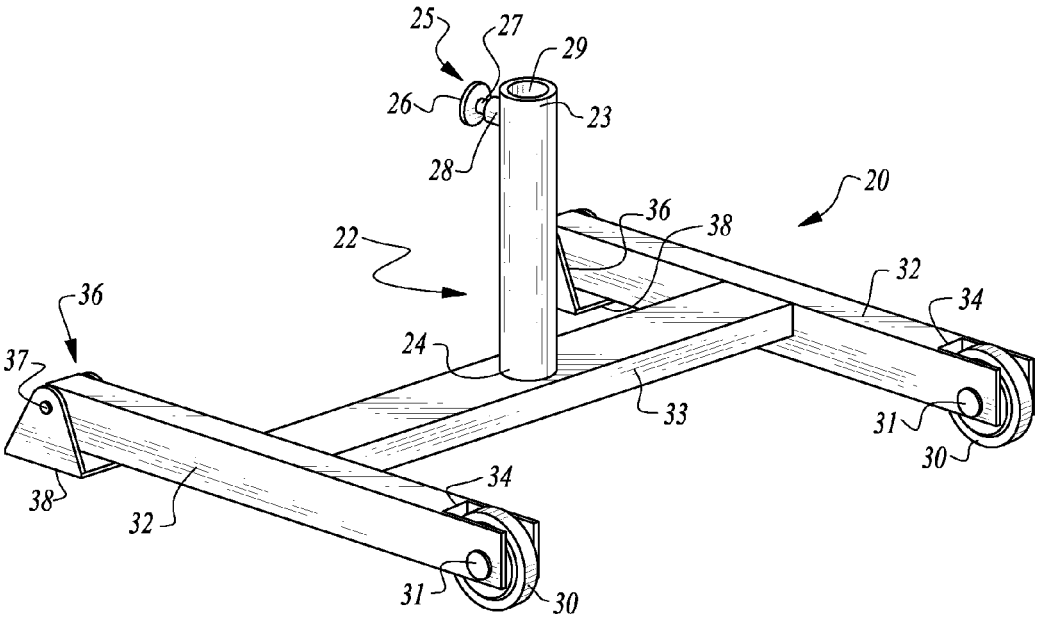
FIG. 4 is a perspective view of that which is shown in FIG. 2.
Figure 5:
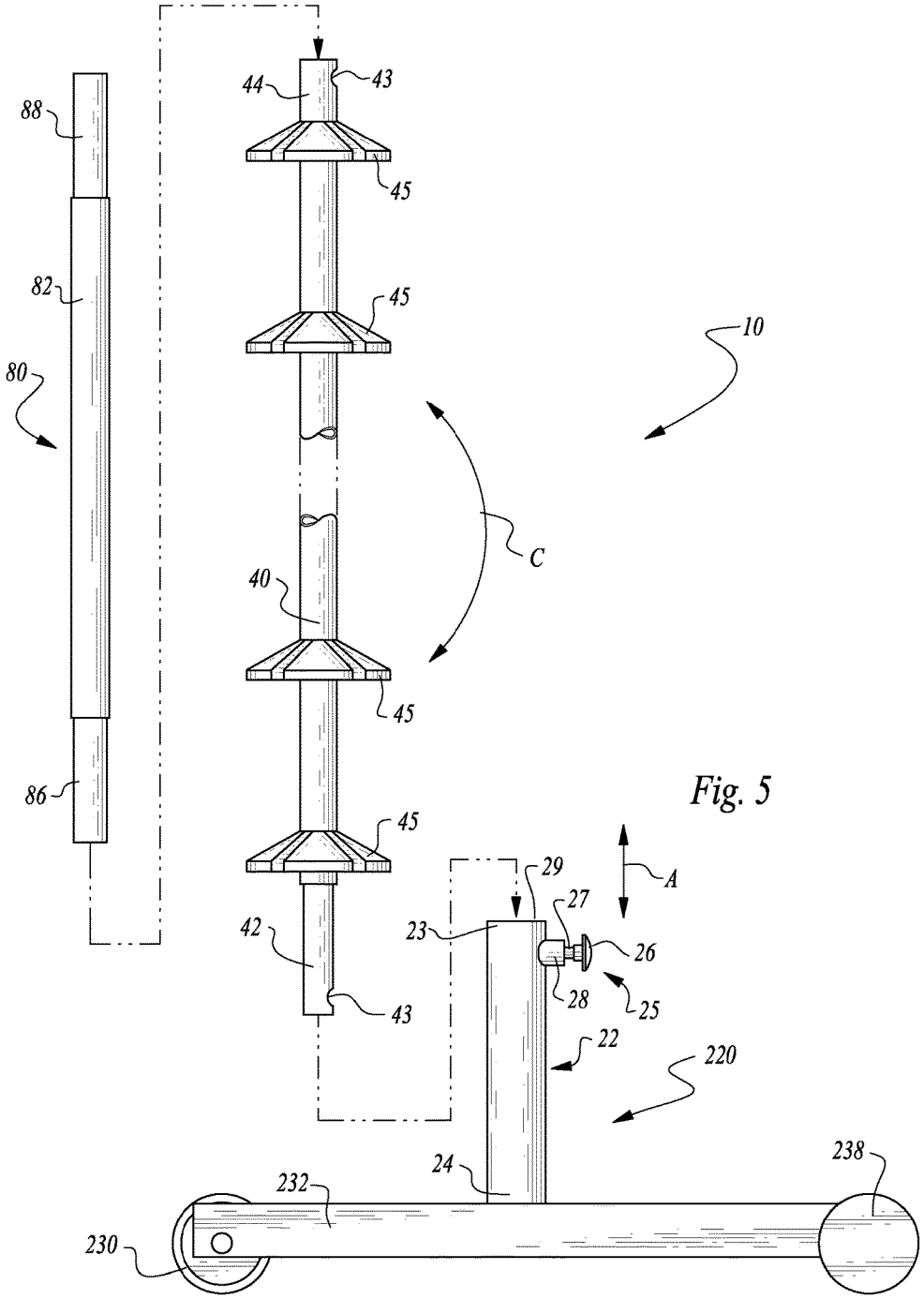
FIG. 5 is a front elevation view of the collapsible artificial tree of this invention with separate portions thereof shown exploded away from each other and illustrating how a main trunk portion can be inverted between a deployed orientation and a collapsed orientation.
Figure 7:
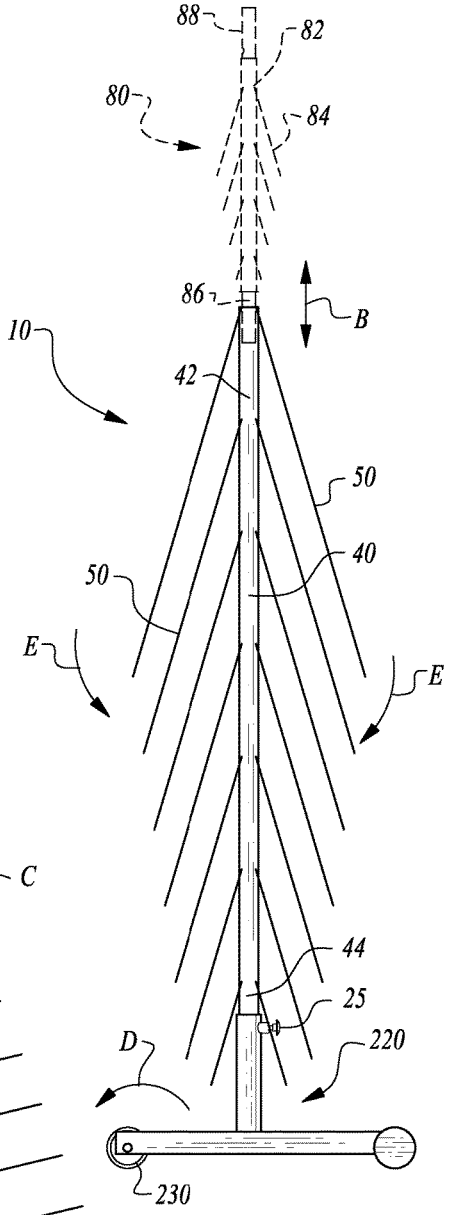
FIG. 7 is a front elevation view of that which is shown in FIG. 6 but after inverting of the main trunk portion, and supported upon the base of an alternative embodiment; and illustrating the collapsed orientation for the collapsible artificial tree, and with a treetop portion shown in broken lines also in a collapsed orientation and resting upon an end of the main trunk of the artificial tree.
Figure 13:
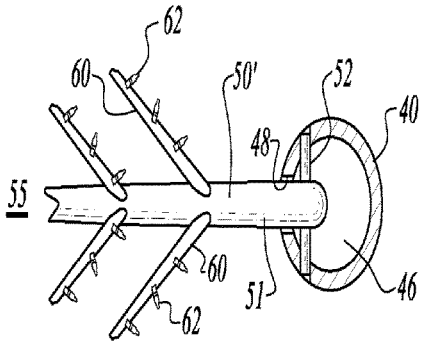
FIG. 13 is a top plan view of that which is shown in FIG. 11.

In essence, and with particular reference to FIGS. 5-7, basic details of the tree 10 are described, according to a most preferred embodiment. The tree 10 includes a base 20 (FIGS. 2-4) which in a preferred form has a series of elements joined together to form a main portion of the base 20. A riser 22 extends up from the base 20 and defines one example of a portion of the base 20 which supports the tree 10 thereon. In particular, the riser 22 includes a hollow core 29 which can receive one of the ends 42, 44 of the main trunk 40 therein for support of the main trunk 40 of the tree 10 in either a deployed configuration (FIG. 6) or in a collapsed configuration (FIG. 7). Wheels 30 are optionally provided on the base 20 to facilitate movement of the tree 10 in either the collapsed configuration or the deployed configuration.

The main trunk 40 (FIGS. 5-7) is elongate in form extending from a first end 42 to a second end 44. Limbs 50 are pivotably attached to the main trunk 40. The limbs 50 are pivoted in such a manner that they extend approximately horizontally when the main trunk has the second end 44 over the first end 42 and with the limbs 50 extending closer to vertically when the first end 42 of the main trunk 40 is over the second end 44 of the main trunk 40 (FIG. 7). Branches 60 optionally extend from the limbs 50 and lights 70 can optionally be provided on the branches 60 with wiring for the lights 70 supported by the main trunk 40. A treetop 80 is also preferably provided which can be removably attached to the second end 44 of the main trunk 40 when the tree 10 is in the deployed configuration (FIG. 6) and which can optionally attach to the first end 42 of the main trunk 40 when the tree 10 has been inverted and is in a collapsed orientation (FIG. 7). A first alternative base 120 (FIGS. 1 and 3) and a second alternative base 220 (FIGS. 5-7) are also provided as alternative forms of the base 20 (FIGS. 2 and 4).

Figure 2:
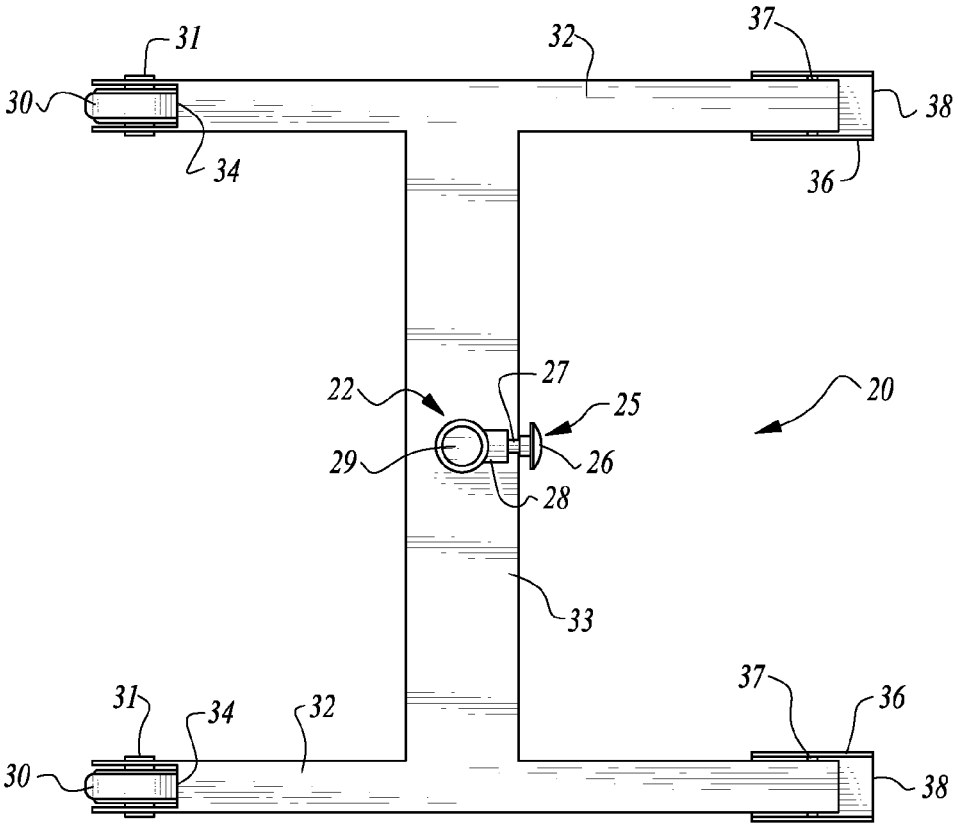
FIG. 2 is a top plan view of a base for the artificial tree of this invention according to a preferred embodiment, the base configured to support the main trunk of the tree in both a deployed and a collapsed orientation.
Figure 3:
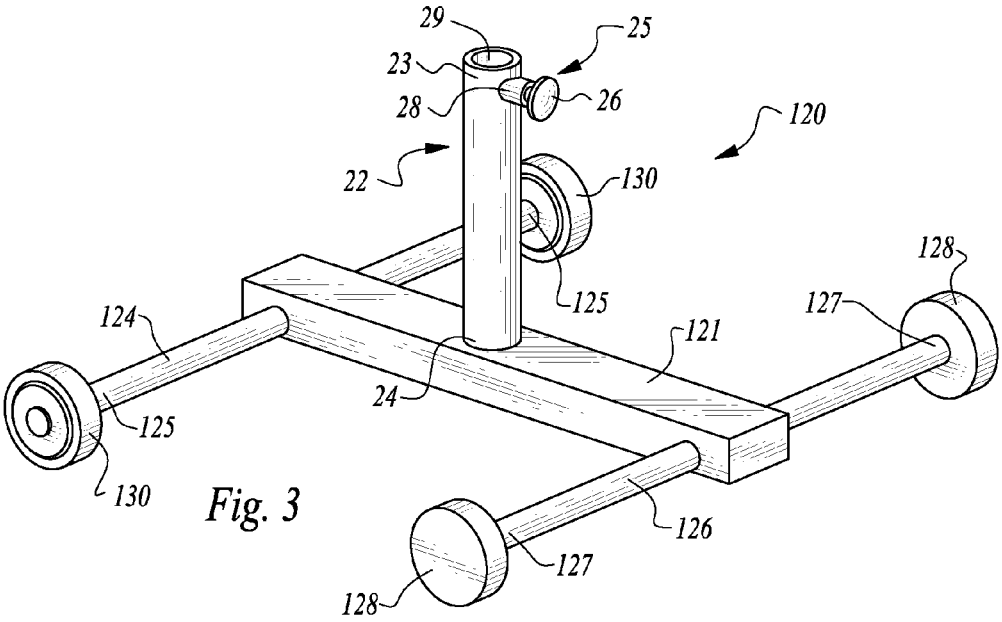
FIG. 3 is a perspective view of that which is shown in FIG. 1.

More specifically, and with particular reference to FIGS. 2-4, basic details of the base 20 of the preferred embodiment are described. The base 20 provides a preferred form of ground support for the tree 10. However, in some embodiments of the tree 10, no base 20 is provided. Ends 42, 44 of the main trunk 40 can be configured to rest upon the ground themselves or to rest upon some other structure built into the ground which is configured to hold the ends 42, 44 of the main trunk 40. For instance, holes of appropriate size can be formed in the ground or some other ground-like manmade structure and ends 42, 44 of the main trunk 40 can be placed therein for deployment and/or storage.

The base 20 generally includes a ground support portion defining an underlying portion of the base 20 which can rest upon a horizontal surface. This ground support portion preferably is configured to come into contact with the ground directly and to also preferably operate in conjunction with wheels 30 which are pivotably attached to the base 20 and also in contact with the ground. With a pair of wheels in contact with the ground and with the ground support portion also in contact with the ground, the base 20 can remain in fixed position when both the ground support portion and the wheels 30 are in contact with the ground, and can be readily moved if the base 20 is tilted slightly (typically with other portions of the tree 10 supported upon the base 20) and then the entire tree 10 and base 20 can be rolled upon the wheels. The tree 10 is thus stable when erected and oriented vertically but can be tilted onto the wheels and then readily rolled from one position to another. Such movement can occur when the tree 10 is in a deployed configuration (FIG. 6) or in a collapsed configuration (FIG. 7).

With the preferred form of base 20, a riser 22 extends vertically up from other portions of the base 20. As an alternative, the riser 22 could be located largely below other portions of the base 20, such that it is in the form of a hole which extends down into the base 20. The riser 22 has a top 23 defining an uppermost portion thereof. A bottom 24 is provided opposite the top 23 and is typically affixed to underlying support portions of the base 20. A lock 25 is preferably provided near the top 23 of the riser 22. This lock 25, in one form, includes a knob 26 which can be grasped by a user and extended toward and away from the riser 22. A shaft 27 is coupled to the knob 26 and can be selectively positioned extending into a hollow core 29 of the riser 22 or pulled out of the hollow core 29 of the riser 22. A horizontal extension 28 is affixed to the riser 22 preferably in a substantially horizontal orientation and with a hollow interior allowing the shaft 27 to move through the horizontal extension 28 and intersect the hollow core 29.

The hollow core 29 preferably extends symmetrically about a central axis of the riser 22. This central axis defines a line along which the main trunk 40 of the tree 10 is oriented when the main trunk 40 is supported upon the base 20 through the riser 22. The ends 42, 44 of the main trunk 40 are each preferably sized to fit within this hollow core 29 of the riser 22 for support of the main trunk 40 of the tree 10 in either the deployed configuration (FIG. 6) or in the collapsed configuration (FIG. 7).

While the riser 22 preferably has the hollow core 29 therein, it is conceivable that the riser 22 could have a solid configuration (or be open) and the ends 42, 44 of the main trunk 40 could be sized to reside over and upon an outer side of the riser 22 so that a diameter of the riser 22 would be smaller than a diameter of hollow ends 42, 44 of the main trunk 40 (or widths if the cross-section of the riser 22 and/or the ends 42, 44 is other than circular).

While the hollow core 29 is preferably defined as residing within the riser 22, the base 20 could have a hole extending down thereinto which would act similarly to the hollow core 29 of the riser 22 and have a central axis along which the main trunk 40 can be oriented. Such a hole extending into the base 20 would thus function as an alternative to the riser 22 of the base 20 and still provide support for the main trunk 40 of the tree 10.

In this preferred embodiment for the base 20, wheels 30 are provided rotatably attached to rigid portions of the base 20 through axles 31. The rigid portions of the base 20 include a series of elements. These elements preferably include outer arms 32 which are parallel to each other and spaced apart by a central arm 33. Two common ends of the outer arms 32 preferably each include wheel gaps 34 thereon. At the wheel gaps 34, central portions of the arms 32 have been removed sufficiently so that the wheel 30 can reside within this wheel gap 34. Axles 31 span the wheel gap 34 and support the wheels 30 in rotating fashion relative to the arms 32. Wheels 30 are sized sufficiently large and positioned upon the axles 31 at appropriate locations so that portions of the wheels 30 extend below lowermost portions of the outer arms 32. In this way, the wheels 30 are in contact with an underlying support surface, when the base 20 is in an upright orientation (see for instance FIG. 4).

Ends of the outer arms 32 opposite the wheels 30 preferably each include a pivoting foot 36. This pivoting foot 36 pivots about a pintle 37 and includes a lowermost portion in the form of a tread 38. The pivoting foot 36 is not strictly required to pivot, but can to some extend accommodate less than entirely flat surfaces more completely with such a pivoting feature. The pivoting foot 36 preferably has a somewhat triangular configuration when viewed from the side so that the tread 38 portion is relatively large to provide a fixed portion of the ground support portion of the base 20 at ends of the outer arms 32 opposite the wheels 30. If desired, locks can be provided on the wheels 30 so that the rotation of the wheels 30 can be prevented, such as when it is desired that the base 20 be particular stable. Utilization of the pivoting foot 36 also particularly resists sliding and horizontal movement of the base 20 in a horizontal direction.

Figure 1:
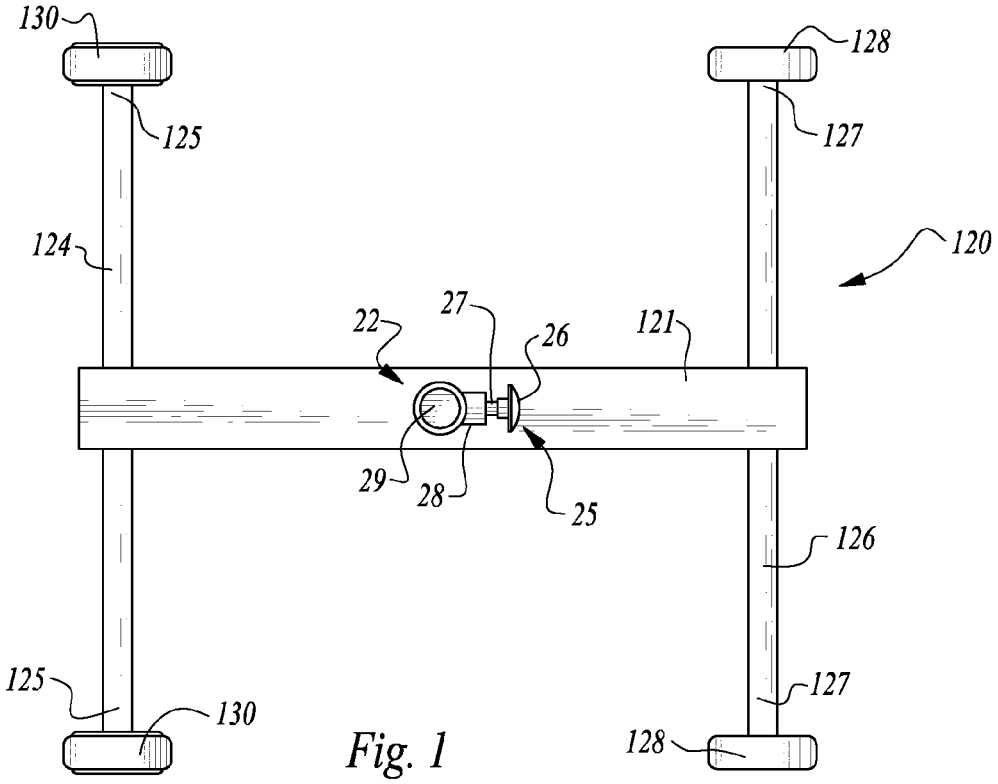
FIG. 1 is a top plan view of an alternative base providing an alternative to the base of FIG. 2, the base configured for supporting a trunk of an artificial tree of this invention thereon in both a deployed orientation and a collapsed orientation.

As an alternative to the base 20, an alternative base 120 is provided (FIGS. 1 and 3). With the alternative base 120, a central member 121 supports the riser 22 with a first axle member 124 at one end of the central member 121 and a second axle member 126 at a second end of the central member 121. Tips 127 of the first axle member include wheels thereon rotatably supported upon the first axle member 124 to facilitate rolling when the alternative base 120 is tipped up onto the wheels 130. Tips 127 of the second axle member 126 include static wheels 128 or other ground support portions thereon. Such static wheels 128 or other ground support portions are preferably fixed to the second axle member 126 to resist movement of the alternative base 120. Perspective views of the base 20 and first alternative base 120 are shown in FIGS. 3 and 4 for comparison of their relative configurations. With either of the bases 20, 120, a similar riser 22 is utilized in a preferred form. Each form of base 20, 120 can also be configured with a hollow core 29 extending down into the base 20, 120, rather than having the riser 22 extending up from other portions of the base 20, 120.

With particular reference to FIGS. 5-7, details of a second alternative base 220 are described. The second alternative base 220 is similar in many respects to the base 20 of the preferred embodiment except that ground support portions which do not rotate are not in the form of the pivoting foot 36, but rather are in the form of a static wheel 238. Thus, the second alternative base 220 includes outer arms 232 with wheels 230 at first ends thereof and with static wheels 238 at second ends thereof opposite the first ends. With any of the bases 20, 120, 220 the tree 10 can be tilted (about arrow D of FIG. 7) up onto the wheels 30, 130, 230 and then rolled about, in either the deployed or the collapsed orientation.

With particular reference to FIGS. 5-7, details of the main trunk 40 are described, according to a most preferred embodiment. The main trunk 40 defines a portion of the collapsible artificial tree 10 which support limbs 50 and other decorative features of the tree 10 and which undergo collapse when the main trunk 40 is inverted (arrow C of FIG. 6). The main trunk 40 is elongate in form and preferably rigid. The main trunk 40 can have various different heights, but it is desirable that the main trunk 40 maintain sufficiently low weight that it can be carried by an individual when grasped by the user's hand and held away from the body far enough to be inverted.

The main trunk 40 extends from a first end 42 to a second end 44. These ends 42, 44 are preferably circular in cross-sectional form and have a size slightly smaller than a size of the hollow core 29. In this way, both the first end 42 and second end 44 can be placed within the hollow core 29 of the base 20. Preferably, when deployed (FIG. 6) the first end 42 of the main trunk 40 is fitted within the hollow core 29 of the riser 22 (FIG. 5). Such positioning of the first end 42 into the riser 22 occurs along arrow A (FIG. 5). The tree 10 thus appears similar to that depicted in FIG. 6. If conversion from the deployed configuration (FIG. 6) to the stored configuration (FIG. 7) is desired, a user first removes the main trunk 40 from the hollow core 29 of the riser 22 of the base 20. The user can then invert the main trunk 40 (about arrow C of FIG. 6), so that the first end 42 and second end 44 are swapped. The second end 44 is preferably configured similarly to the first end 42 so that the second end 44 can be inserted into the riser 22 of the base 20 so that the base 20 functions to support other portions of the tree 10 both when in a deployed orientation and in a collapsed orientation (FIG. 7).

In one embodiment, the main trunk 40 includes limb support collars 45 at spaced intervals there along. These limb support collars 45 are provided adjacent where limbs 50 are pivotably attached to the base 20. Each limb 50 includes a root 51 adjacent the main trunk 40 and opposite a tip 55. An axle 52 is provided attaching the limbs 50 in a rotatable fashion to the main trunk 40. A stop 54 is provided on at least one side of where the limbs 50 attach to the main trunk 40 which stop acts to keep the limbs 50 from pivoting beyond an amount desired. The limbs 50 can be configured in a variety of different ways and be pivotably attached to the main trunk 40 in a variety of different ways. In one embodiment the limbs 50 are attached to the main trunk 40 in the manner depicted in FIGS. 8-12.

With particular reference to FIGS. 12-17, details of the limbs 50 and branches 60 of the tree 10 are described according to one embodiment. The limbs 50 could be attached to the trunk 40 in many different ways including in fixed fashion or in a fashion which is removable but not pivotable. However, most preferably the limbs 50 are pivotably attached to the trunk 40. Such pivoting preferably allows for rotation of the limbs 50 between a perpendicular orientation (actually substantially perpendicular but preferably slightly angled upwardly, when the trunk 40 is oriented vertically) and a collapsed configuration closer to the angle of the trunk 40 centerline than to perpendicular to the trunk 40 centerline.

Figure 11:
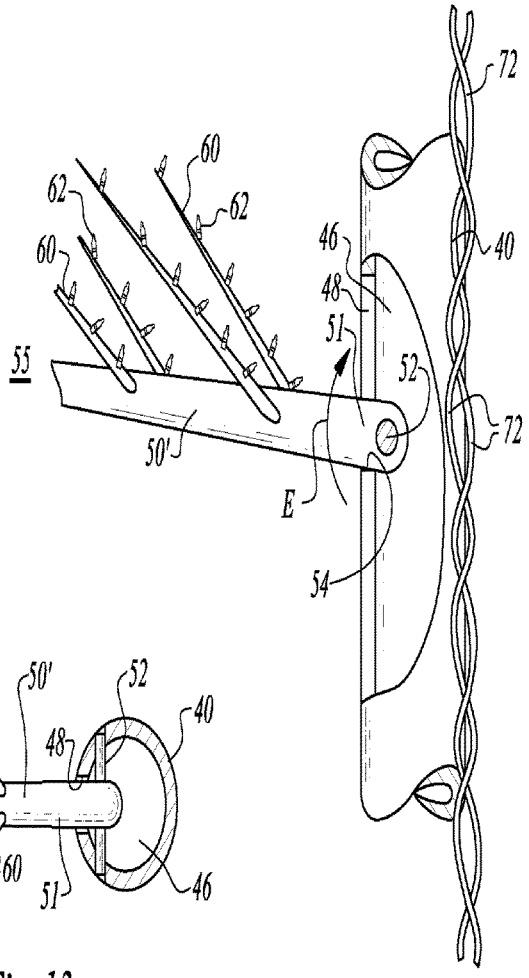
FIG. 11 is a detail similar to that which is shown in FIG. 8, but for an alternative embodiment limb and limb attachment to the second trunk portion.

Most preferably, this collapsed angle for the limbs 50 is 70° away from the deployed configuration for the limbs 50. Such rotation of the limbs 50 is depicted by arrow E (FIGS. 8, 9 and 11). While the limbs appear to pivot upward, they in fact pivot downward after the trunk 40 has rotated (about arrow C (FIG. 8)) so that the limbs 50 actually rotate downward by gravity forces, but only when the trunk 40 has been rotated from the deployed configuration to the stored orientation. When this action is reversed and the trunk 40 is rotated from the stored orientation to the deployed orientation, the limbs 50 pivot in an opposite direction to the deployed configuration approximately perpendicular to a centerline of the trunk 40.

Each of the limbs 50 is preferably an elongate rigid structure with a plurality of such limbs 50 radiating from the rotating trunk 40. Most preferably, the limbs 50 extend in many different directions radially from the trunk 40 (FIG. 10) when a complete symmetrical generally conical bushy invertible Christmas tree 10 is to be provided. The limbs 50 generally each include a root 51 defining an end thereof closest to the trunk 40 and a tip 55 opposite the root 51. A hinge 52 is located at the root 51 to pivotably attach the limbs 50 to the trunk 40. A stop 54 is provided to prevent the limbs 50 from rotating either past substantially horizontal and perpendicular to the trunk 40 when in the deployed configuration or past a collapsed angle, such as 70°, away from the deployed configuration.

A core 46 passing through an interior of the trunk 40 is preferably hollow. Such a hollow core 46 minimizes weight of the trunk 40 while maintaining strength for the trunk 40 and also optionally provides a pathway through which electric equipment for the lights 70 can be routed. Slots 48 (FIGS. 8-13) are formed in the trunk 40 through which limbs 50 can interface in a rotating fashion relative to the trunk 40.

Figure 12:
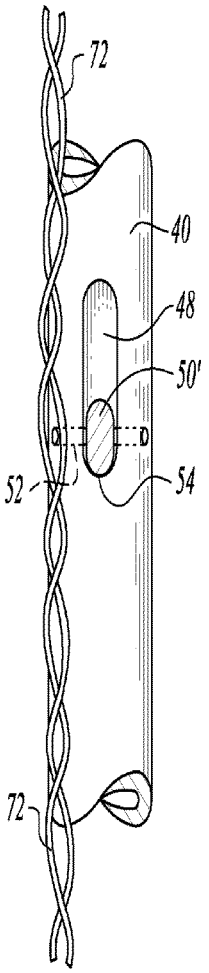
FIG. 12 is a side elevation view of that which is shown in FIG. 11.

In the embodiment of FIGS. 8 and 9 this stop 54 is in the form of a flange of material extending substantially perpendicularly from the extent of the limbs 50 from the root 51 to the tip 55. In the embodiment of FIGS. 11 and 12 the root 51 of the limbs 50 merely passes through a slot 48 in the trunk 40 and a lower portion of this slot 48 acts as the stop 54. The hinge 52 generally includes at least one axle 52 or axle-like structure about which the limbs 50 can pivotably move relative to the trunk 40.

Branches 60 optionally but preferably radiate from the limbs 50 in a pattern which mimics at least some natural tree or otherwise has a desirable form. Typically, needles also extend from the branches 60. These needles 62 can be actual natural needles such as pine needles, but most typically are synthetic structures such as attached by wire or adhesive to the branches 60. It is also conceivable that needles 62 can also be directly attached to the limbs 50. The branches 60 can have a generally planar form such as might exist on a noble fir, or might have a more bushy cylindrical form which might be provided on many different types of pines. Needles 62 can also be long or short depending on the design characteristics desired for the tree 10.

With particular reference to FIGS. 8-12, details of the lights 70 are described. Most preferably, the tree 10 is also permanently wired with lights 70. A plug 74 is provided which is removably attachable to a power receptacle P. A cord 72 extends from the plug 74 to the rotating trunk 40. At the joint 36, this cord 72 preferably splits into two separate cords, one of which extends towards the first end 42 of the trunk 40 and the other of which extends towards the second end 44 of the trunk 40.

As these cords pass the limbs 50, the cords are routed out the limbs 50 and terminate at various different locations with lights 70. Various different controllers can be provided and various different lights can be provided if desired so that a variety of different light displays can be provided through the lights 70. The cord 72 can be routed through an interior of the trunk 40 (and also conceivable through an interior of the limbs 50). Perhaps in a simplest form of the invention, the cord 72 can merely be wrapped around an exterior of the fixed trunk 30 and an exterior of the trunk 40. The cord 72 can be camouflaged to have a color similar to that of the fixed trunk 30, trunk 40 and limbs 50 (i.e. green) to help hide the cords 72.

Most preferably the main trunk 40 and limbs 50 extending therefrom do not define the entire tree 10 above the base 20. Rather, a treetop 80 is preferably provided which is removably attachable to the second end 44 of the main trunk 40 to define an uppermost portion of the tree 10. This treetop 80 includes a top trunk 82 with limbs 84 extending therefrom laterally. These limbs 84 could be in fixed orientation relative to the trunk 82 or could pivot similar to the pivoting of the limbs 50 relative to the main trunk 40.

The trunk 82 extends from an upper end 86 to a lower end 88. The lower end 88 is configured to be attachable to the second end 44 of the main trunk 40 (FIG. 6). Furthermore, the upper end 86 of the treetop 80 can optionally be configured to be attachable to the second end 44 of the main trunk 40. In such a configuration, the treetop 80 can be stored when resting upon the uppermost first end 42 of the main trunk 40 when the tree 10 is in the collapsed orientation (FIG. 7). As another alternative, when collapsed the treetop 80 can be supported upon a separate support riser extending upward from a portion of the base 20 provided for this particular purpose.

The treetop 80 would also typically be sufficiently light and easy to handle that it could be stored in a separate box away from the main trunk 40 and base 20. Attachment of the treetop 80 to the main trunk 40 occurs along arrow B (FIGS. 6 and 7). The entire tree 10 and base 20 can be pivoted together up onto the wheels 30, 130, 230, such by pivoting about arrow D (FIG. 7) to facilitate rolling of the tree 10. Pivoting of the limbs 50 relative to the main trunk 40 occurs along arrow E (FIG. 7).

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. An artificial tree comprising:

a trunk including a first end and a second end;

a plurality of limbs attached to the trunk adapted to move between a display position and a storage position; and a base having a ground support portion adapted to rest upon an underlying surface, the base adapted to support each of the first end or the second end of the trunk, such that when the second end is supported by the base with the first end substantially vertically above the second end, the limbs move toward the storage position to be closer to the trunk than in the display position, the base being adapted to accommodate the limbs in the storage position while the second end is supported by the base.

2. The tree of claim 1, wherein the limbs are adapted to be in the display position when the first end of the trunk is supported by the base with the second end substantially vertically above the first end.

3. The tree of claim 1, wherein the base comprises a support mount extending from the ground support portion of the base, the support mount including a hole sized larger than at least one of the first end or the second end of the trunk to enable the at least one of first end or the second end of the trunk to be inserted into the hole to support the trunk.

4. The tree of claim 3, wherein at least one of the first end or the second end of the trunk is sized to reside over and upon an outer side of the support mount to support the trunk with respect to the base.

5. The tree of claim 1, wherein the base comprises support mount extending from the ground support portion of the base, the support mount including an elongate post extending from the base away from the underlying surface, the elongate post sized smaller than each of the first end and the second end of the trunk to enable each of the first end or the second end of the trunk to extend along a central axis of the elongate post for support of the trunk substantially vertically with respect to the underlying surface on which the base rests.

6. The tree of claim 1, further comprising a lock adapted to releasably secure the at least one of the first end or the second end of the trunk to the base.

7. The tree of claim 1, wherein the ground support portion of the base includes at least two wheels to contact the underlying surface and another portion opposite the wheels to contact the underlying surface, such that the base can roll when tilted onto the wheels and resists rolling when at least the other portion of the ground support portion of the base contacts the underlying surface.

8. The tree of claim 1, wherein the base includes a central arm extending substantially horizontally with the ground support portion, the base including a riser located in a central portion of the central arm, the central arm extending out to a pair of outer arms substantially parallel to each other and at opposite ends of the central arm, the outer arms each having a wheel pivoting from one end and a pivoting foot opposite the wheels, the pivoting foot of each the outer arms adapted to resist rolling, and the wheels adapted to roll.

9. The tree of claim 1, further comprising a treetop that includes a top trunk and a plurality of limbs extending laterally from the top trunk, the top trunk of the treetop being removably attachable to the second end of the trunk.

10. The tree of claim 9, wherein the limbs of the treetop are adapted to pivot relative to the top trunk.

11. The tree of claim 1, wherein the base includes a hole extending into the base to receive either the first end or the second end of the trunk to support the trunk.

12. An artificial tree comprising:

a trunk including a first end and a second end;

a plurality of limbs attached to the trunk adapted to move between a display position and a storage position; and a base having a ground support portion adapted to rest upon an underlying surface, the base adapted to support each of the first end or the second end of the trunk, such that when the second end is supported by the base with the first end substantially vertically above the second end, the limbs move toward the storage position so as to be closer to the trunk than in the display position, wherein the ground support portion includes a pivoting foot with a surface comprising a tread to contact the underlying surface, such that the base resists rolling when resting on the pivoting foot, the pivoting foot being adapted to enable the base to rotate about the tread on a plane substantially perpendicular to the underlying surface while the tread maintains the contact with the underlying surface.

13. The tree of claim 12, wherein the base is adapted to accommodate the limbs in the storage position while the second end is supported by the base.

14. The tree of claim 12, wherein the pivoting foot further comprises a pintle extending through the pivoting foot and a portion of the base to provide for rotation of the base about the pintle.

15. The tree of claim 12, wherein the base comprises a support mount extending from the ground support portion of the base, the support mount including a hole sized larger than the first end and the second end of the trunk to enable the first end and the second end of the trunk to be inserted into the hole to support the trunk.

16. The tree of claim 15, wherein the base includes a hole extending into the base to receive either the first end or the second end of the trunk to support the trunk.

17. A method of using an artificial tree, the artificial tree having a main trunk including a first end spaced axially apart from a second end thereof, the method comprising:

resting a base of the artificial tree upon an underlying surface, the base including a riser extending upward from the base while resting on the underlying surface;

the second end of the main trunk being attached to the riser of the base with the first end of the main trunk substantially vertically above the second end such that gravity urges a plurality of limbs toward a storage configuration in which the limbs are closer to vertical than in a deployed configuration;

removing the second end of the main trunk from the riser; and attaching the first end of the main trunk to the riser of the base with the second end of the main trunk substantially vertically above the first end such that gravity urges the plurality of limbs toward the deployed configuration.

18. The method of claim 17, wherein while the main trunk is supported by the base, the method further comprises:

tilting the artificial tree onto wheels attached to a ground support portion of the base.

19. The method of claim 18, further comprising rolling the artificial tree on the wheels from one position on the underlying surface to another.

20. The method of claim 19, wherein the rolling occurs while the artificial tree is in one of the deployed configuration or the storage configuration.

21. The method of claim 18, wherein the tilting occurs about at least one pivoting foot attached to the base opposite the wheels, each pivoting foot adapted to resist rolling on the wheels when the wheels and each pivoting foot is resting on the underlying surface.

22. The method of claim 17, further comprising locking the first end or the second end of the main trunk to the base.

23. The method of claim 17 further comprising attaching a treetop to the second end of the main trunk.

24. An artificial tree comprising:

a main trunk including a first end and a second end;

a plurality of limbs attached to the main trunk adapted to move between a display position and a storage position;

a base having a ground support portion adapted to rest upon an underlying surface, the base including a riser extending from the base, each of the first end and the second end of the main trunk being adapted to attach to the riser to support the main trunk and limbs above the base;

a treetop that includes a top trunk and a plurality of limbs extending laterally from the top trunk, the top trunk of the treetop adapted to removably attach to the second end of the main trunk;

wherein when the second end is supported by the base with the first end substantially vertically above the second end, the limbs move toward the storage position as to be closer to the main trunk than in the display position, the base being adapted to accommodate the limbs in the storage position while the second end is supported by the base; and wherein when the first end is supported by the base with the second end substantially vertically above the first end, the limbs move toward the display position further away from the main trunk than in the storage position.

25. The tree of claim 24, wherein the base further comprises:

wheels to contact the underlying surface to enable the base to be rolled when tilted onto the wheels; and at least one pivoting foot spaced apart from the wheels and including a contact surface to engage the underlying surface, the pivoting foot adapted to pivot about a pintle while the contact surface engages the underlying surface to provide for rotation of the base about the pintle when the riser of the base is tilted toward the pivoting foot, the pivoting foot resisting movement of the base when the contact surface engages the underlying surface.

* * * * *